United States Patent [19]

Barnes

[11] 3,967,454

[45] July 6, 1976

[54] TRENCH SHORING APPARATUS

[76] Inventor: Miles W. Barnes, 315 Third St., Long Beach, Calif. 90802

[22] Filed: Feb. 3, 1975

[21] Appl. No.: 546,274

[52] U.S. Cl. ..... 61/41 A; 61/72.1; 61/63

[51] Int. Cl.[2] ..... E02D 5/02; E02D 5/06

[58] Field of Search ..... 61/41 A, 41, 42, 63, 61/84, 85, 72.1

[56] References Cited

UNITED STATES PATENTS

| | | | |
|---|---|---|---|
| 2,908,140 | 10/1959 | Everson | 61/41 A |
| 3,280,572 | 10/1966 | Hatton | 61/85 |
| 3,407,609 | 10/1968 | Kosogorin | 61/85 X |
| 3,606,757 | 9/1971 | De Weese et al. | 61/41 A |
| 3,864,925 | 2/1975 | Foik | 61/84 X |

*Primary Examiner*—Dennis L. Taylor

[57] ABSTRACT

Self propelled apparatus for the shoring of the walls of an excavation including a support frame and side panels slidingly carried on the frame at each side thereof for horizontal movement relative thereto and for bearing against the wall of the excavation to prevent the collapse thereof. Hydraulic rams are provided to extend and retract the side panels. Cooperative locking mechanisms are carried by the side panels for locking the panels together when they are in the extended position. Control means is provided to simultaneously reverse the hydraulic rams when the side panels on each side are fully extended and the control means cooperate with the locking mechanisms to cause the side panels to move as a unit from the extended to the retracted position. The friction between the excavation walls and the side panels being greater than the friction between the frame and floor of the excavation results in the side panels acting as an anchor to draw the frame along the floor of the excavation. As the panels are fully retracted with respect to the frame, the control means reverses the hydraulic flow and camming arms carried by the frame disengage the locking mechanisms for extension of each of the panels individually.

10 Claims, 8 Drawing Figures

REG.

TRENCH SHORING APPARATUS

BACKGROUND OF THE INVENTION

This invention relates to earth excavation and more particularly to self-propelled apparatus adapted to move along the floor of trenches to shore the walls thereof during excavation.

Trench shoring equipment is used to shore the walls of a trench to provide lateral support for the excavation walls to prevent the collapse thereof and to provide a good working environment for personnel in the trench during the laying of pipe and the like. Various designs for self-propelled trench shoring apparatus are known in the art, however, a preferred design is of the general type disclosed in U.S. Pat. No. 2,908,140 granted Oct. 13, 1959 to Kirk B. Everson, Jr. Such apparatus comprises a supporting frame adapted to be moved along the trench and extendable-retractable panels carried on the sides of the frames for longitudinal movement relative to the frame. The panels are driven by hydraulic cylinders which are capable of being driven in either direction for the longitudinal extension and retraction of the panels. In the preferred mode of operation the panels are extended individually ahead of the frame and are retracted simultaneously. The friction between the panels and the excavation walls is greater than the opposing force of the frame against the hydraulic cylinders causing the frame to move forward in the trench responsive to the retraction of the cylinders.

Devices of the general type described above provide substantially continuous pressure against the walls of the excavation and thus are effective even in unstable soil conditions. However, even these shoring devices are defective in that unless the bearing friction between each of the panels and the excavation walls is substantially uniform, one or more of the panel members may begin to slide along the trench wall during the retraction phase in the operation. This will result in reduction in the number of panels serving as an anchor to draw the frame forward in the trench. Since the panels are all independently movable, the opposing force will be transferred to a reduced number of panels which may overload the hydraulic system leading to those panels resulting in equipment breakdowns and a less than complete forward movement of the frame. In addition, with the prior art apparatus care must be exercised to insure that the cylinders are reversed simultaneously in order to insure that the panels are moved as a unit during the retraction cycle so that the entire anchoring force of the panels is utilized for drawing the frame forward in the trench.

SUMMARY OF THE INVENTION

The present invention relates to improved self-propelled shoring apparatus of the general type described by Everson comprising a frame, defining opposing sides and adapted for movement along a trench floor. A plurality of longitudinally movable side panels are carried on each of the sides of the frame for movement between an extended and a retracted position relative to the frame. The side panels extend generally in the plane of the trench walls and bear there against to prevent the collapse of the trench walls. Locking means are carried on each of the side panels for interengagement with cooperating means on adjacent side panels when the side panels are aligned in the fully extended position.

The side panels are driven by a plurality of reversible hydraulic rams, preferably one ram for each panel. Automatic control means are utilized to simultaneously reverse the rams from the extending mode to the retracting mode when all of the panels are fully extended. In this manner the side panels are locked into a single unit and retracted in unison. Camming means carried by the frame disengage the locking means when the side panels are fully retracted so that the panels on each side can be extended on an individual basis and in a random sequence.

In the foregoing manner, the panels are retracted as a unit thereby eliminating problems which may occur as a result of unevenness of bearing friction between the trench walls and the individual side panels. Other advantages of the present invention reside in the reduction of the number of persons required to operate the apparatus, the provision of a transverse screed gate to accurately control and maintain the elevation of the apparatus and in the simplicity and inexpensiveness of the construction of the apparatus.

These and other objects and advantages of the present invention will be apparent from the following detailed description taken in conjunction with the accompanying drawings.

DETAILED DESCRIPTION OF THE INVENTION

Figure 1:
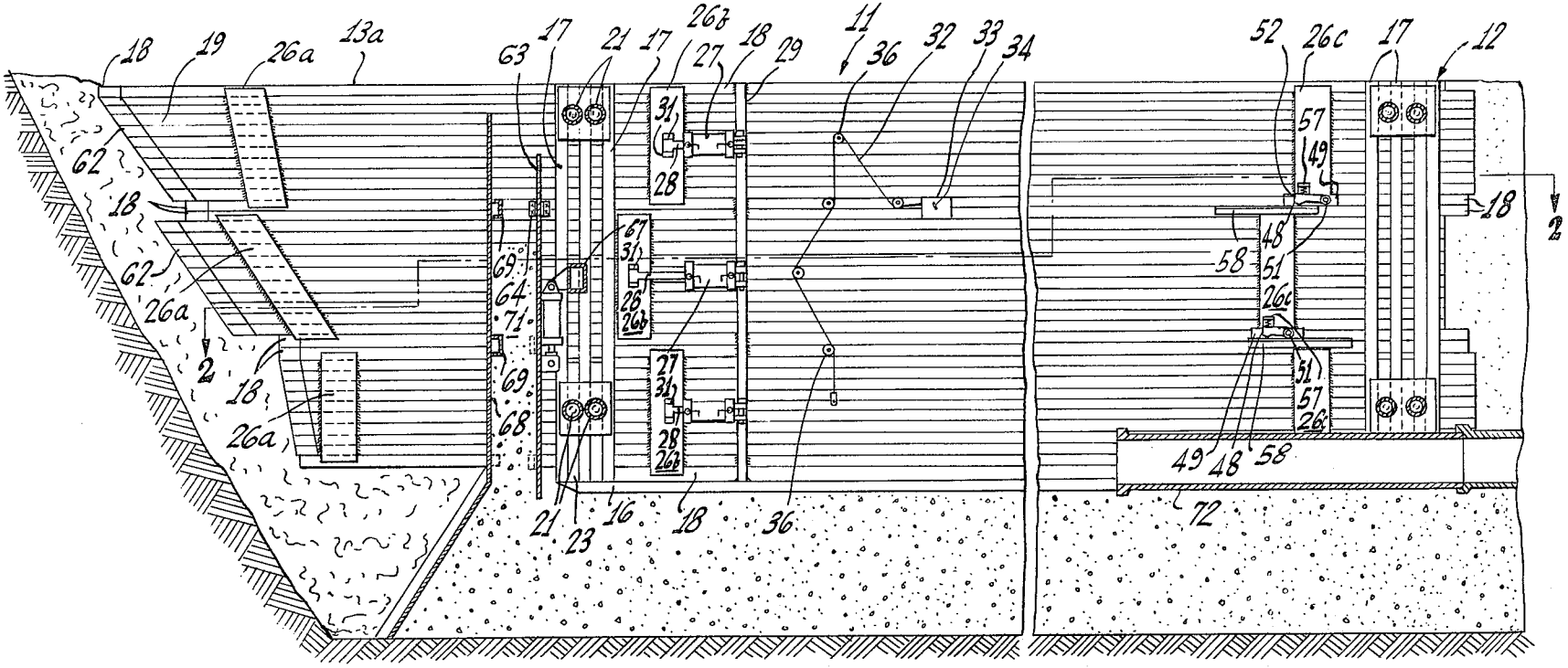
FIG. 1 is a side elevation, partly in cross-section and partially broken away for compactness of illustration, showing one side of the apparatus of the present invention with one panel extended and two panels retracted.
Figures 2, 3, 4, 5, 6, 7, 8:
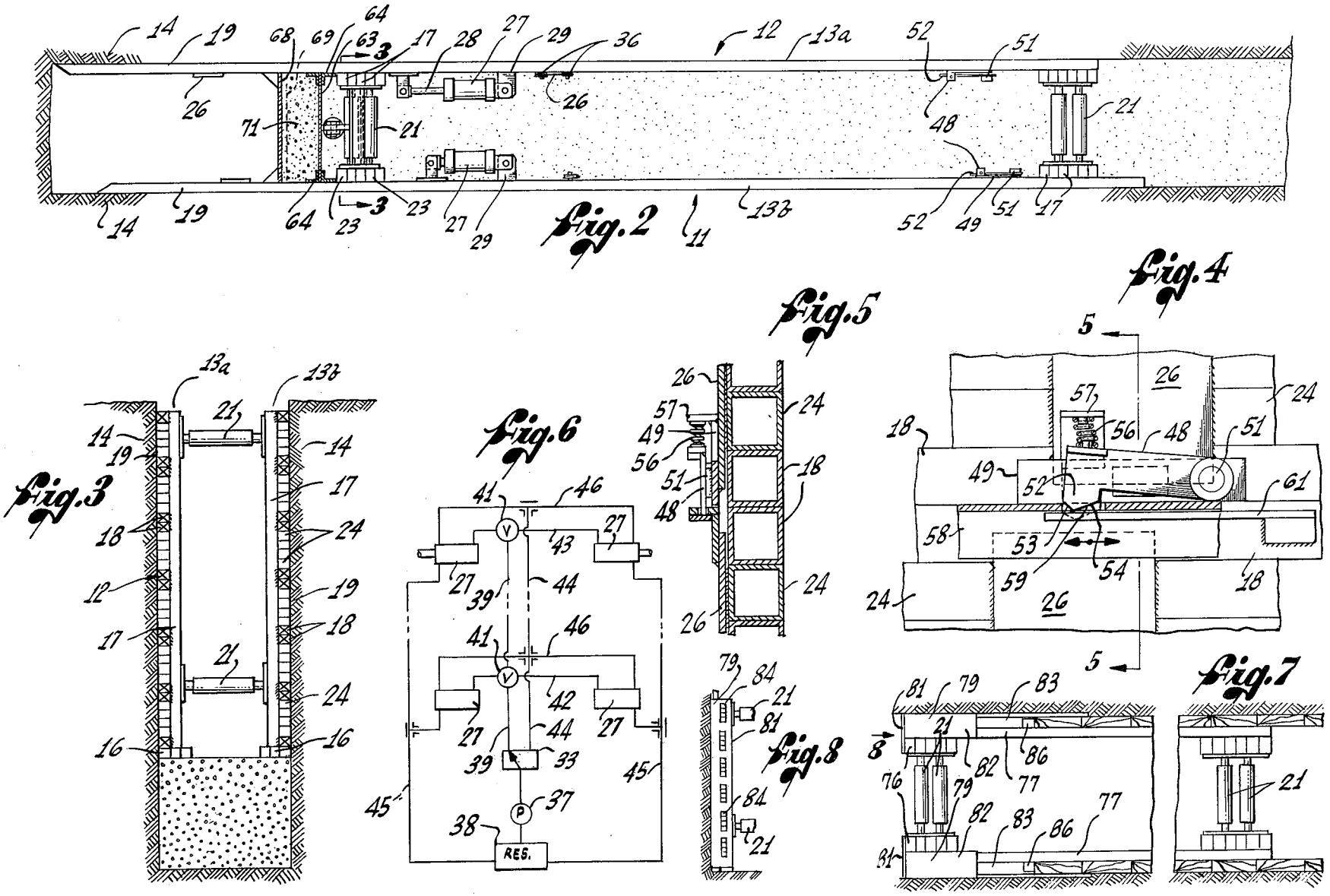
FIG. 2 is a top sectional view taken through line 2—2 of FIG. 1.
FIG. 3 is a front cross-sectional view taken through line 3—3 of FIG. 2.
FIG. 4 is an enlarged fragmentary view, partially in section showing the mechanism for interlocking adjacent panels of a side of the apparatus illustrated in FIG. 1.
FIG. 5 is a sectional view taken through line 5—5 of FIG. 4.
FIG. 6 is a schematic diagram of a hydraulic system for extending and retracting the panels of the apparatus of the present invention.
FIG. 7 is a top plan view, partially broken away for compactness of illustration of another embodiment of the present invention.
FIG. 8 is a front elevation along line 8 of FIG. 7.

The invention is shown embodied in the drawings and particularly in FIGS. 1 and 2 wherein a trench shoring apparatus, shown generally as 11 comprises a generally rectangular frame 12 including opposed sides **13*a* and 13*b* extending generally parallel to the plane of their respective adjacent trench walls 14. Each of the sides 13*a* and 13*b* includes a supporting runner 16, a plurality of uprights 17 longitudinally spaced along the runner adjacent the leading and trailing ends thereof and removably attached thereto, such as by means of sockets, not shown, which are adapted to receive the lower ends of the uprights. A plurality of longitudinal stringers 18 are affixed to and extend between the uprights 17 along the outer sides of the uprights facing the trench wall. The stringers 18 are spaced apart on the uprights 17 so as to carry a trench lining panel 19 between adjacent pairs of the stringers. In the embodiment shown, these panels 19** are disposed on each of the sides 13*a* and 13*b* for depth wise movement, however, the number of panels carried on each side is not critical and will vary depending on the height of the trench wall 14 and the panel width.

The sides 13*a* and 13*b* of the frame 12 are maintained in spaced relation to the walls of the trench by adjustable length cross-braces 21 which extend transversely between opposing uprights 17 and set against brace plates 22 for maintaining the sides 13*a* and 13*b* against the trench walls 14. The width of the frame 12 can be adjusted by adjusting the length of the cross-braces 21 to accommodate varying trench widths.

Additional reinforcement is provided at the forward and trailing end portions of the runners 16 by short uprights 23 which are disposed between the uprights 17 and are secured to the stringers 18. In addition, the bearing capacity of the frame 12 can be improved by a transverse breasting plate, not shown, which extends between the leading ends of the runners 16.

Each of the side panels 19 comprises a plurality of generally rectangular tubes 24 arranged with the opposing longitudinal faces aligned and contiguous. Straps 26*a*, *b*, and *c* are longitudinally spaced along the panels 19 for securing the tubes 24. In addition, the straps 26*a*, *b*, and *c* extend beyond the longitudinal edges of the panel 19 so that the end portions overlap the stringers 18 carrying the panel to guide the panel as it moves longitudinally along the stringers. Inward movement of the panels 19 off of the stringers 18 is prevented by the uprights 17 which also function to guide the panels and maintain them in proper alignment between their respective stringers.

Each of the panels 19 are moved between the extended and retracted position by a reversible hydraulic ram 27 connected to a source of hydraulic fluid (FIG. 6). The cylinder of the ram 27 is carried by an upright 29 and the outer end of the connecting rod is attached to the panel 19 at strap 26 by suitable means such as, for example, spaced apart ears 31 receiving therebetween the end of the connecting rod which is secured by bolt, not shown, in the ears and the connecting rod end. Depending on the direction of hydraulic flow the panels 19 are driven lengthwise along the stringers 18 between the extended and retracted portions.

An important feature of the present invention resides in the provision of control means for simultaneously reversing the flow of hydraulic fluid to the rams 27 when the panels 19 have all reached the extended position.

As is most clearly shown in FIG. 1, a fixed length cable 32 is secured at one end to a sequencing valve 33 by a spring loaded trigger 34, and at its opposite end to the frame 12 so that the cable extends across at least a portion of the inner faces of each of the panels 19 on one side of the frame. A plurality of cable takeup pulleys 36 are disposed on the panels 19 and stringers 18 for taking up the cable 32 to rotate the trigger 34 and operate the sequencing valve 33 as the panels 19 are advanced into the extended position.

As is most clearly shown in FIG. 6 the sequencing valve 33 is in fluid communication at its inlet with a pump 37 which communicates with a pump 38 for hydraulic fluid. Outlet line 39 communicates through valve 41 with feeder lines 42 and 43 for leading fluid to the cylinder of the rams 27 for the extension of the connecting rods 28. Likewise, outlet line 44 communicates with feeder lines 46 and 47 for leading fluid to the opposite end of the cylinders of the rams 27 for retracting the connecting rods 28. Hydraulic fluid from the rams 27 is returned to the sump 38 through lines 45. The valves 41 control the flow of fluid through the feeder lines 42 and 43 so that opposing pairs of rams 27 are operated in any sequence desired and independently of the other opposed pairs of rams. It should be clear, however, that the hydraulic rams 27 on both sides of the frame 12 may be operated independently provided that in the sequence of extension, the last ram to be extended is a ram on the side of the frame bearing the cable 32 in order to avoid actuating the sequencing valve 33 prior to advancing all of the panels 19.

Although mechanical actuation of the sequencing valve 33 is preferred in view of the environment in which the apparatus 11 operates, alternate control means can be employed. For example, the sequencing valve can be actuated by line pressure as is known in the art or hydraulic flow reversal can be controlled by electrically operated solenoid valves which are activated by a position sensitive limit switch. As mentioned, these alternate control means are not preferred in view of malfunctions which may occur by introduction of foreign particles into the system.

In addition to means for synchronizing the reversal of hydraulic fluid flow and for synchronizing the operation of the rams 27 for retraction of the panels 19, locking means are provided between adjacent panels for mechanically linking together the panels of each of the sides 13*a* and 13*b* of the frame 12 to insure that the panels of each side can only move in unison during retraction. The locking means are operative only during retraction of the panels 19 and are disengaged when the panels are in the fully retracted position.

As is most clearly shown in FIGS. 1, 5 and 6, a locking arm 48 is pivotally mounted at one end thereof on the inner face at the lower edge of each of the panels 19 that are upwardly adjacent to other panels on the sides 13*a* and 13*b* of the frame 12. Mounting of the arm 48 is conveniently achieved by securing to the lower end portion of the strap 26, a mounting plate 49 which receives a shaft 51 for pivotally carrying the arm. The free end of the locking arm 48 depends downwardly to define a latch head 52 having front and rear camming surfaces 53 and 54 respectively. A spring 56 acting against an inwardly extending flange 57 carried by the plate 49 carried on the strap 27 acts against the latch head for urging the locking arm downwardly.

A latch plate 58 is secured to the upper edge portion of the strap 26 of the lower adjacent panels 19 and extends perpendicularly thereto. A locking slot 59 is provided in the latch plate 58 for the extension therethrough of the latch head 52 when the adjacent panels 19 are aligned.

An elongated camming arm 61 is secured on the stringer 18 rearwardly of the latch plate 58 and extends beneath the latch plate for contacting the rear camming surface 54 of the latch head 52 to urge the locking arm 48 upwardly when the panels 19 are fully retracted with respect to the frame 12.

In operation, a short length of trench sufficient to receive the shoring apparatus 11 is excavated and the shoring apparatus is lowered into, or alternatively, is assembled in the trench. The width of the frame 12 is adjusted to the width of the trench by adjusting the cross braces 21 so that the panels 19 are in frictional contact with the walls 14 of the trench. It may be preferable to make the initial excavation slightly wider than the desired width in order to provide sufficient tolerance for positioning the apparatus 11 in the trench. Frictional contact between the panels 19 and the trench walls 14 is then achieved by back filling against outer faces of the panels.

The panels 19 are initially in the fully retracted position with the camming arms 61 extending beneath the latch plate 58 to urge the locking arms 48 upwardly out of locking engagement with the respective latch plates. The sequencing valve 33 is positioned to permit the flow of hydraulic fluid through the line 39.

As excavation proceeds, the panels are advanced by opening valves 41 to permit fluid flow through the feeder lines 42 and 43 to extend the rams 27 and advance the panels 19 along the stringers 18 a distance equal to the length of the stroke of the rams. The valves 27 are opened in random sequence so that only one of the panels 19 on each side 13*a* and 13*b* is advanced so as to ease the resistance to advancement caused by frictional contact between the panel and the trench wall 14 and by the trimming of excess soil from the trench wall by the leading edge of the panel. As the panels are advanced, the latch head 52 rides upwardly out of the slot 59 when either of the camming surfaces 53 and 54 contact an edge of the locking slot. The cable take up pulley 36 of the advancing panel 19 engages the cable and carries a portion of it forward with the panel while a portion is restrained by the pulleys carried by the stringers 18, thereby increasing the tension on the trigger 34. As any two adjacent panels 19 of a side of the frame 12 are fully extended, the locking slot 59 of the lower adjacent panel is aligned with the latch head 52 of the upper adjacent panel and the latch head is urged into the locking slot by the spring 56 so as to lock the adjacent panels together.

Upon extension of the last opposing pair of panels 19, the tension exerted on the trigger 34 by the take up of the cable 32 is sufficient to rotate the trigger and activate the sequencing valve 33 so that the flow of hydraulic fluid through the line 39 and the feeder lines 43 is now directed through the line 44 and feeder lines 46 to simultaneously reverse the direction of the rams 27.

The total force generated by the frictional contact between all of the panels 19 and the trench walls 14 being greater than the frictional resistance between the runners 16 and the trench floor, the frame 12 is caused to slide forwardly on the runners 16 so that the frame is advanced along the trench floor while the panels are stationary with respect to the walls of the trench. As the panels 19 and frame 12 are drawn into the retracted position, the tension on the trigger 34 is released, and the trigger is returned to its first position, and the sequencing valve 33 is positioned to return the flow of hydraulic fluid to the line 39. The camming arms 61 urge the respective latch heads 52 upwardly in the latching slots 59, so that the panels 19 of each side are free for individual movement with respect to adjacent panels, and the cycle is repeated.

As shown in FIG. 1, the stringers 18 and the panels 19 preferably extend forwardly of the leading edges of the runners 16 and are provided with a chisel edge 62 to aid in trimming soil from the freshly excavated trench walls 14. In this manner, advancement of the panels aids in the excavation of the trench.

As is most clearly shown in FIGS. 1 and 2, the level of the apparatus 11 in the trench is controlled by a vertically adjustable transverse screed gate 63 carried on the frame 12 forward of the runners in channels 64. A hydraulic cylinder 66 carried by the frame 12 by an adjustable length transverse mounting bar 67 interconnects the screed gate 63 and frame 12 for adjustment of the vertical height of the screed gate. The lower edge of the screed gate 63 is in contact with the trench floor to adjust the level thereof over which the runners 16 are to travel. A target, not shown, is provided on the rear face of the screed gate 63 for setting the screed gate by surveying instrument or similar accurate means.

The screed gate 63 is particularly useful in combination with a hopper plate 68 which extends transversely to the frame 12, and is carried thereon by adjustable length mounting bars 69 so as to define in combination with the screed gate, a hopper 71 for the introduction of gravel to the trench floor prior to the laying of pipe 72 or the like thereon. The screed gate 63 levels the gravel bed at the proper elevation as the gravel is fed through the hopper 71 and the apparatus 11 is drawn forward. Excavation is conveniently and safely carried out in the area defined by the hopper plate 68 and forwardly extending portions of the panels 19.

The vertical height of the frame 12 can be readily adjusted by extending the uprights 17 such as by adding additional lengths to the upper ends thereof, and by adding additional stringers 18. Likewise the number of panels 19 and rams 27 can be increased to compensate for the additional height.

As shown in FIGS. 7 and 8, another embodiment of the apparatus 11 is shown which is adapted for the placing of shoring timbers for permanent reinforcement of the trench walls. In this embodiment, a frame 74 is defined by uprights 76 and stringers 77 and movable side panels 78 are carried by the frame in the manner already described. The outer faces of the panels 78 are spaced away from the trench walls by a cowl 79 secured on the leading upright 78 of the frame 74 at each side thereof by inwardly turned front and top edges, 81 and 82 respectively. The side faces of the cowl 79 extend rearwardly of the top edge 82 to permit access to a space 83 thus formed between the outer face of the panels 78 and the cowl 79 on each side of the frame 74 into which timber shoring 75 is inserted. The forward edge 81 of the cowl is provided with spaced apart openings 84 for the extension therethrough of the panels 78. Driving lugs 86 are provided on the outer faces of the panels 78 for urging the timbers together and for anchoring the panels during the retraction phase of operation. In this embodiment, the leading edges of the panels 78 are coterminous with the leading edge of the frame 74 when fully retracted and the driving lugs 86 are spaced rearwardly of the front edge 81 of the cowl 79 a distance equal to at least the length of the stroke of the driving rams, not shown, so as not to interfere with the full extension of the panels through the openings 84.

In operation the panels 78 are advanced simultaneously and the timbers 75 placed in the space 83. The sequencing valve, not shown, is activated as described to reverse the hydraulic rams. The driving lugs 86 contact the forward most timber as the panels 78 are retracted, forcing the newly positioned timbers together. When no further movement of timbers is possible, the driving lugs 86 anchor the panels 78 resulting in the forward movement of the frame 74. When the panels 78 are fully retracted with respect to the frame 74, the sequencing valve is repositioned and the cycle repeated. In this embodiment, the sequencing valve can be manually operated since the panels 78 are preferably extended and retracted in unison.

I claim:

1. A self propelled trench shoring apparatus comprising:

a frame supported on a lower supporting surface of said trench and adapted for travel therealong, said frame defining opposed, transversely spaced apart sides, each side comprising a plurality of longitudinally spaced uprights and a plurality of longitudinally extending supports carried by said uprights in spaced relationship to each other;

panel members disposed between pairs of said supports for longitudinal movement with respect thereto;

locking means carried by each of said panel members for engagement with locking means on adjacent panel members for cooperative engagement therebetween to lock adjacent panel members together for movement in unison;

means for disengaging said locking means for longitudinal movement of said panel members with respect to at least one of said adjacent panel members;

reversible drive means for urging said panel members longitudinally between a retracted position and an extended position with respect to said frame; and means controlling said drive means for the extension of said panel members and for reversing said drive means responsive to the position of said panel members for the simultaneous retraction thereof in cooperation with said locking means.

2. The apparatus of claim 1 wherein said frame further comprises a supporting runner extending longitudinally beneath each side of said frame for carrying said frame on said lower supporting surface of said trench.

3. The apparatus of claim 1 wherein said locking means comprises a locking arm pivotally connected at one end to said panel member adjacent the lower edge thereof, the free end of said arm defining a downwardly extending latch head, a perpendicularly extending latch plate carried on the upper edge of a lower adjacent panel member, said latch plate having a through running aperture for the extension therethrough of said latch head of said locking arm when said adjacent panel members are fully extended, thereby locking said adjacent panel members together; and said means disengaging said locking means comprises an elongated camming arm carried by said longitudinal support of said frame at the upper edge of said lower adjacent panel member, said elongated camming arm affixed to said support rearwardly of said latch plate and extending beneath said latch plate to pivot said locking arm out of said aperture when said panel members are fully retracted, thereby to free said panel member for individual longitudinal movement into said extended position.

4. The apparatus of claim 1 wherein said drive means comprises a plurality of extendable and contractable hydraulic rams, each said ram interconnecting said frame and at least one of said panel members and being adapted to receive a fluid for the extension and contraction thereof thereby to extend and retract said panel members relative to said frame; and said control means including valve means operable when said panel members are aligned in the fully extended and the fully retracted position to change the flow of fluid through said hydraulic rams to reverse the movement thereof.

5. The apparatus of claim 1 further including a vertically adjustable screed gate extending transversely between opposing uprights adjacent one end of said frame, said screed gate defining the leading end of said frame, the bottom edge of said screed gate normally contacting the surface of said trench on which said frame is supported and acting thereagainst to define the level of said surface over which said frame travels.

6. The apparatus of claim 5 further including a transverse hopper plate carried by said frame forward of said screed gate, said hopper plate and said screed gate defining therebetween a vertically extending hopper for containing and introducing material to said trench.

7. In a trench shoring apparatus comprising a frame adapted for travel along a trench floor, said frame defining transversely spaced apart sides, each side comprising a plurality of longitudinally spaced uprights and a plurality of longitudinally extending supports carried by said uprights, a plurality of longitudinally movable panel members disposed on each of said sides and means for driving said panels between an extended and retracted position with respect to said frame, the improvement comprising:

a cowl disposed on the leading edge of each of said sides of said frame, said cowl including a rearwardly extending side face spaced outwardly from said side and defining between said side face and the outer surface of said panel members a space for receiving elongated, vertically disposed shoring members.

8. The apparatus of claim 7 wherein said cowl defines an inwardly turned forward edge secured to the leading upright of said side and carrying said rearwardly extending side face, said forward edge of said cowl having a plurality of vertically aligned, spaced apart openings which correspond to and are aligned with said panel member leading edges to permit their extension therethrough when said panel members are in the extended position.

9. The apparatus of claim 7 wherein said cowl includes an inwardly turned upper edge secured to the upper longitudinally extending support of said side and secure to said leading edge and said rearwardly extending side face of said cowl, said side face extending rearwardly beyond said upper edge to provide access to said space defined between said side face and said panel members for the insertion of said shoring members.

10. The apparatus of claim 7 further including at least one outwardly extending driving lug disposed on at least one of said panel members of each of said sides, said driving lug extending into said space between said side face of said cowl and said panel members for contact with a shoring member to anchor said panel members during the retraction thereof thereby to cause the forward travel of said frame along said trench floor.

* * * * *